United States Patent [19]

Kadija

[11] 4,207,164

[45] Jun. 10, 1980

[54] DIAPHRAGMS FOR USE IN THE ELECTROLYSIS OF ALKALI METAL CHLORIDES

[75] Inventor: Igor V. Kadija, Cleveland, Tenn.

[73] Assignee: Olin Corporation, New Haven, Conn.

[21] Appl. No.: 947,236

[22] Filed: Sep. 29, 1978

Related U.S. Application Data

[63] Continuation-in-part of Ser. No. 838,600, Oct. 3, 1977, Pat. No. 4,165,271.

[51] Int. Cl.[2] ..... C25B 13/06; C25B 1/46

[52] U.S. Cl. ..... 204/253; 204/252; 204/295; 204/296

[58] Field of Search ..... 204/295, 296, 253

[56] References Cited

U.S. PATENT DOCUMENTS

| | | | |
|---|---|---|---|
| 2,116,509 | 5/1938 | Cottrell | 204/283 X |
| 3,407,249 | 10/1968 | Landi | 204/296 X |
| 3,424,659 | 1/1969 | Staal | 204/74 |
| 3,702,267 | 11/1972 | Grot | 429/34 |
| 3,923,630 | 12/1975 | Argade et al. | 204/266 |
| 4,024,036 | 5/1977 | Nakamura et al. | 204/129 |
| 4,081,350 | 3/1978 | Kadija et al. | 204/296 |
| 4,130,473 | 12/1978 | Eddleman | 204/252 |

FOREIGN PATENT DOCUMENTS

| | | | |
|---|---|---|---|
| 7249424 | 12/1972 | Japan | 204/296 |

*Primary Examiner*—F. C. Edmundson

*Attorney, Agent, or Firm*—James B. Haglind; Donald F. Clements

[57] ABSTRACT

A diaphragm for use in the electrolysis of aqueous solutions of ionizable compounds in electrolytic diaphragm cells is comprised of a support fabric impregnated with particles of a siliceous composition having the formula:

$$(X)_m(Si)_p(O)_q(H)_r \cdot nH_2O$$

wherein

X is at least one metal selected from the group consisting of Be, Mg, Ca, Sr, Ba, Ti, Zr, Al, Zn and mixtures thereof;

p is a number from 1 to about 16;

m is zero to about p;

q is a number from 2 to about 5p+r;

r is zero to about 4p; and n is zero to about 30.

The siliceous compositions are capable of undergoing hydration when in contact with at least one of the ionizable compounds in the electrolytic cell. The support fabric has an electroconductive zone along one side.

The diaphragms are physically and chemically stable, provide reduced cell voltages during operation of the cell and have increased operational life.

23 Claims, 9 Drawing Figures

DIAPHRAGMS FOR USE IN THE ELECTROLYSIS OF ALKALI METAL CHLORIDES

This application is a continuation-in-part of co-pending application U.S. Ser. No. 838,600, filed Oct. 3, 1977 now U.S. Pat. No. 4,165,271;

This invention relates to diaphragm-type electrolytic cells for the electrolysis of aqueous solutions of ionizable compounds. More particularly, this invention relates to novel diaphragms for electrolytic diaphragm cells.

In an electrolytic diaphragm cell, the diaphragm represents the cell component which permits the cell to operate by producing, where the electrolyte is an aqueous solution of an ionizable compound, products such as chlorine, alkali metal hydroxide, hydrogen and oxygen at current efficiencies which are high enough to be economically viable. The separation properties, as indicated by the current efficiencies, can be increased by, for example, increasing the thickness or density of the diaphragm. These changes, however, usually result in an increase in the electrical resistance of the diaphragm, as indicated, for example, by an increase in the voltage coefficient. Favorable cell economics depend on increasing or maintaining at a high level the current efficiency while restraining or minimizing the increase in voltage coefficient.

For years commercial diaphragm cells have been used for the production of chlorine and alkali metal hydroxides, hydrogen and oxygen which employed a porous diaphragm of asbestos fibers. In employing asbestos diaphragms, it is thought that the effective diaphragm is a gel layer formed within the asbestos mat. This gel layer is formed by the decomposition of the asbestos fibers in contact with the electrolytes in the cell. When electrolyzing aqueous salt solutions, in addition to undergoing chemical decomposition during operation of the cell, the asbestos fibers also suffer from dimensional instability as they are distorted by dissolution swelling. Porous asbestos diaphragms while satisfactorily producing, for example, chlorine, and alkali metal hydroxide solutions, have limited cell life and once removed from the cell, cannot be re-used. Further, asbestos has now been identified by the Environmental Protection Agency of the U.S. Government as a health hazard.

Therefore there is a need for diaphragms having increased operating life while employing materials which are durable as well as inexpensive.

It is an object of the present invention to provide a diaphragm having efficient separation properties and providing reduced cell voltage during cell operation.

Another object of the present invention is to provide a diaphragm having increased stability and a longer operational life when employed in the electrolysis of aqueous solutions of ionizable compounds.

Yet another object of the present invention is the use of ecologically acceptable non-polluting materials in diaphragm compositions.

An additional object of the present invention is a diaphragm having support materials which are chemically and physically stable during electrolysis.

A further object of the present invention is a diaphragm which can be handled easily during installation in and removal from the electrolytic cell.

These and other objects of the invention will be apparent from the following description of the invention.

These and other objects of the invention are accomplished in a porous diaphragm for an electrolytic cell for the electrolysis of aqueous solutions of ionizable compounds which comprises a support fabric impregnated with particles of a siliceous composition having the formula:

$$(X)_m(Si)_p(O)_q(H)_r \cdot nH_2O \qquad \text{I}$$

wherein

X is at least one metal selected from the group consisting of Be, Mg, Ca, Sr, Ba, Ti, Zr, Al, Zn, and mixtures thereof;

p is a number from 1 to about 16;

m is zero to about p;

q is a number from 2 to about 5p+r;

r is zero to about 4p; and n is zero to about 30, the siliceous compositions being capable of undergoing hydration when in contact with at least one of the ionizable compounds in the electrolytic cell; and the support fabric having an electroconductive zone along one side of the support fabric.

Accompanying FIGS. 1–9 illustrate the novel diaphragm of the present invention.

Figure 1:
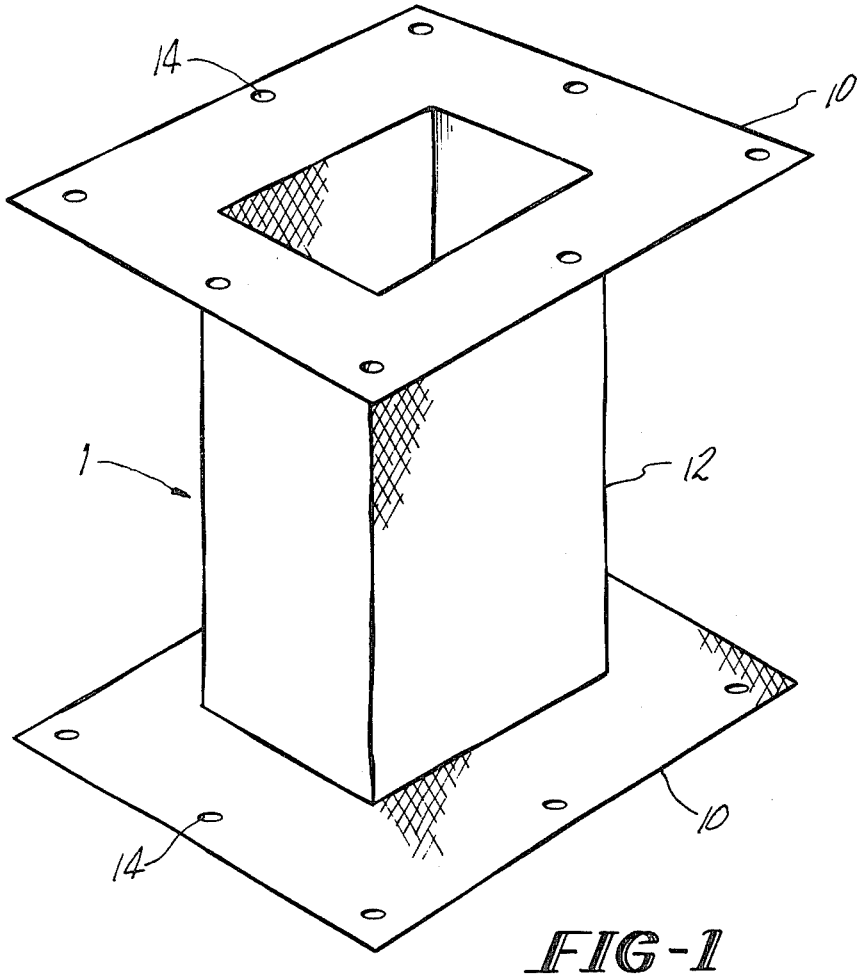
FIG. 1 illustrates a perspective view of one embodiment of the diaphragm of the present invention.

FIG. 1 illustrates a diaphragm of the present invention suitable for covering a cathode. Diaphragm 1, comprised of fabric, has end portions 10 attached, for example, by sewing, to diaphragm body 12. Diaphragm body 12 is a hollow rectangle which is mounted on a cathode (not shown) so that it surrounds the cathode on all sides. End portions 10 have openings 14 which permit end portions 10 to be attached to the cell walls (not shown).

Figure 2:
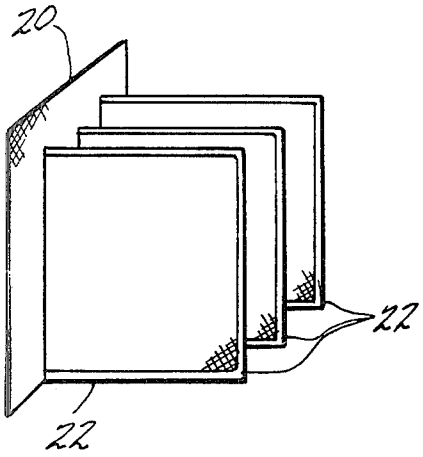
FIG. 2 shows a perspective view of one embodiment of the diaphragm of the present invention suitable for use with a plurality of electrodes.

FIG. 2 depicts a diaphragm suitable for use with a plurality of electrodes. Fabric panel 20 has fabric casings 22 attached substantially perpendicular to the plane of panel 20. Fabric casings 22 are suitably spaced apart from each other and are attached to fabric panel 20, for example, by sewing. Fabric panel 20 has openings (not shown) corresponding to the area where fabric casings 22 are attached to permit the electrodes to be inserted in fabric casings 22.

Figure 3:
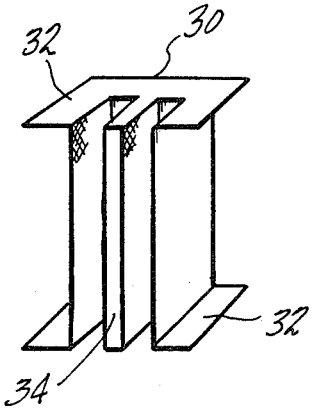
FIG. 3 depicts a perspective view of an additional embodiment of the diaphragm of the present invention for use with a plurality of electrodes.

FIG. 3 illustrates another embodiment of the diaphragm of the present invention. U-shaped fabric panel 30 has end portions 32 for attachment to the cell walls (not shown). Fabric casing 34 is attached to U-shaped fabric panel 30, for example, by sewing. An opening (not shown) at the bottom of fabric casing 34 permits the diaphragm to be installed on a vertically positioned electrode.

Figure 4:
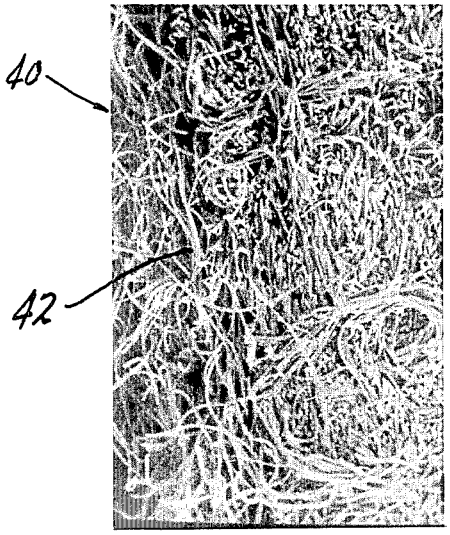
FIG. 4 is a photomicrograph of a cross section of one embodiment of the support fabric employed in the diaphragms of the present invention (magnified 30 times).

FIG. 4 shows a cross section of a polytetrafluoroethylene felt support fabric 40 having fibers 42 randomly oriented.

Figure 5:
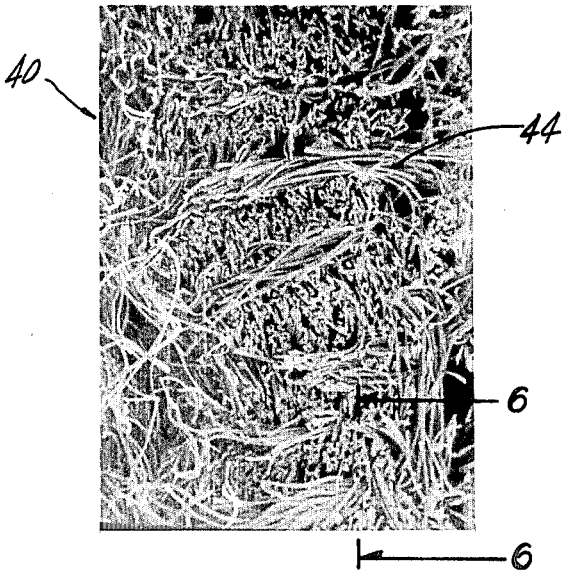
FIG. 5 is a photomicrograph of a planar cross section of an embodiment of the support fabric having fiber bundles (magnified 30 times).

The embodiment of the support fabric 40 illustrated in FIG. 5 has, at regular intervals, fiber bundles 44 which are substantially perpendicular to the plane of the outer surface of fabric 40. Fiber bundles 44 penetrate the entire width of support fabric 40. The support fabric is a polytetrafluoroethylene felt fabric where the magnification shown in the photomicrograph is 30 times the original.

Figure 6:
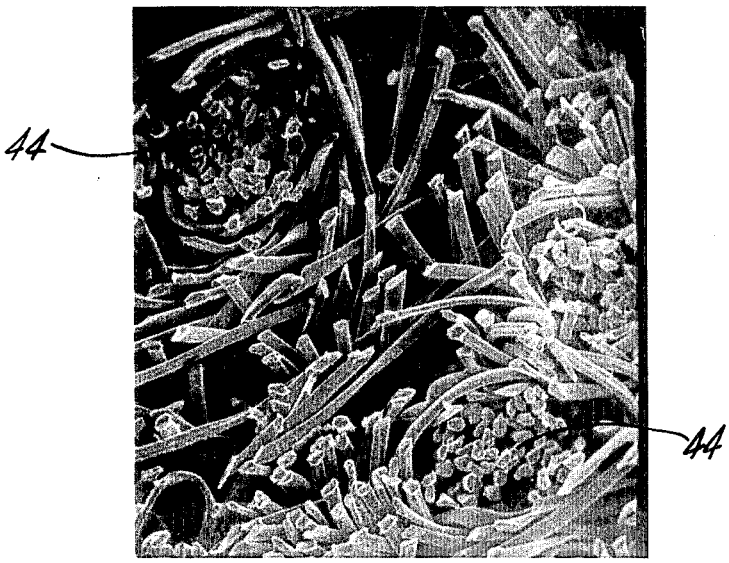
FIG. 6 is a cross section of FIG. 5 taken along line 6—6.

FIG. 6 illustrates fiber bundles 44 found in a cross section of FIG. 5 along line 6—6 where the magnification is 120 times.

Figure 7:
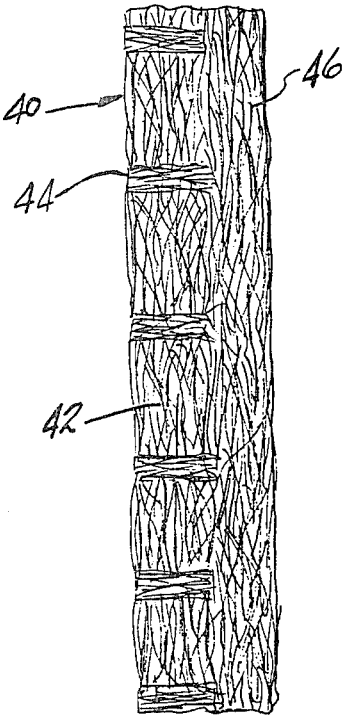
FIGS. 7–9 illustrate a cross section of several embodiments of the support fabric.

Portrayed in FIG. 7 is an embodiment of support fabric 40 in which fiber bundles 44 only partially penetrate the support fabric leaving section 46 having fibers generally oriented in a vertical direction.

Figure 8:
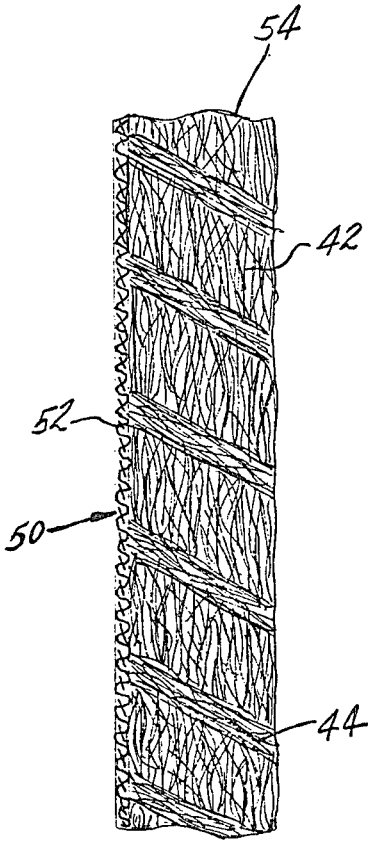

Layered support fabric 50, shown in FIG. 8, has as a first layer 52, a highly porous fabric. Contiguous to first layer 52 is second layer 54 having fiber bundles 44 on a diagonal to the generally vertically oriented fibers 42.

Figure 9:
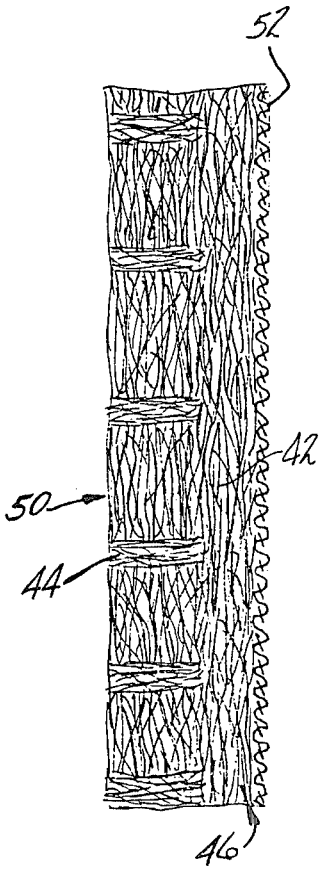

The embodiment of layered support fabrics 50 illustrated in FIG. 9 has first layer 52 of a highly porous fabric non-adjacent to second layer 54. Second layer 54 has fiber bundles 44 partially penetrating second layer 54. Section 46, having fibers generally oriented in a vertical direction is adjacent to first layer 52.

More in detail, the novel diaphragms of the present invention comprise a support fabric which is impregnated with the siliceous composition.

A fabric is employed which is produced from materials which are chemically resistant to and dimensionally stable in the gases and electrolytes present in the electrolytic cell. The fabric support is substantially non-swelling, non-conducting and non-dissolving during operation of the electrolytic cell. The fabric support is also non-rigid and is sufficiently flexible to be shaped to the contour of an electrode if desired.

Suitable fabric supports are those which can be handled easily without suffering physical damage. This includes handling before and after they have been impregnated with the active component. Suitable support fabrics can be removed from the cell following electrolysis, treated or repaired, if necessary, and replaced in the cell for further use without suffering substantial degradation or damage.

Support fabrics having uniform permeability throughout the fabric are quite suitable in diaphragms of the present invention. FIG. 4 illustrates support fabrics of this type. Prior to impregnation with the siliceous composition of Formula I, these support fabrics should have a permeability to gases such as air of, for example, from about 5 to about 500, preferably from about 20 to about 200 and more preferably from about 30 to about 100 cubic feet per minute per square foot of fabric. Uniform permeability throughout the support fabric is not, however, required and it may be advantageous to have a greater permeability in one portion of the support fabric. When impregnated, this portion may be positioned closest to, for example, the anode in the electrolytic cell. Layered structures thus may be employed as support fabrics having, a first layer which when the diaphragm is installed in the cell, will be in contact with the anolyte, and a second layer which will be in contact with the catholyte. The first layer may have, for example, an air permeability of, for example, from about 100 to about 500 cubic feet per minute. The first layer may be, for example, a net having openings which are slightly larger than the particle size of the active ingredient with which it is impregnated.

The second layer, in contact with the catholyte when installed in the cell may, for example, have an air permeability of from about 5 to about 100 cubic feet per minute. For the purpose of using a selected size of active component containing silica, the layered support fabric can be produced by attaching, for example, a net to a felt fabric. The net permits the particles to pass through and these are retained on the felt.

Permeability values for the support fabric may be determined, for example, using American Society for Testing Materials Method D737-75, Standard Test Method for Air Permeability of Textile Fabrics.

The support fabrics may be produced in any suitable manner. Suitable forms are those which promote absorption of the active component including sponge-like fabric forms. Preferred forms of support fabric are felt fabrics, i.e., fabrics having a high degree of interfiber entanglement or interconnection which are usually non-woven. When employing felt as a support fabric, fluids passing through the fabric take a tortuous route through the randomly distributed, highly entangled fibers. The permeability of these fabrics is of a general nature, i.e., non-linear and non-controlled.

Permeability of these support fabrics may be increased by means which alter the structure of the support fabric. As illustrated in FIGS. 5–9, the support fabrics have been modified by providing means for linear permeability, for example, fiber bundles distributed throughout the support fabric. Spaced apart at regular or irregular intervals, the fiber bundles improve permeability by providing regions through which the flow of fluids such as alkali metal chloride brines are substantially laminar. Laminar flow reduces turbulence or mixing of fluids in the region and results in a homogeneous fluid throughout the region.

To provide fiber bundles in the support fabric, the fabric is, for example, needled or punched at intervals along the surface of the fabric. The depth of the needling may be controlled to provide fiber bundles which penetrate through the fabric, as shown in FIGS. 5–6 and 8, or fiber bundles which only partially penetrate the fabric, as illustrated in FIGS. 7 and 9.

Fiber bundles may be positioned at any suitable angle to the plane of the outer surface of the support fabric. For example, the angle of the fiber bundles may be from about 90 to about 45 degrees from the vertical and preferably from about 90 to about 60 degrees.

Fiber bundles contain a plurality of fibers, for example, up to several hundred fibers may comprise a bundle. The bundles are distributed throughout the support fabric, which may contain several hundred bundles per square inch of fabric.

The fiber bundles provide linear permeability which substantially increases the permeability of the support fabric. Any suitable amount of total permeability of the support fabric may be provided by the inclusion of fiber bundles. For example, fiber bundles may provide from about 15 to about 70 percent of the permeability of the support fabric. Preferably, fiber bundles provide from about 20 to about 50 and more preferably from about 30 to about 40 percent of the permeability of the support fabric.

In addition to improving the permeability, the fiber bundles facilitate the impregnation of the support fabric with the siliceous composition and aid in providing a more uniform distribution of the siliceous composition within the support fabric.

A further advantage of the presence of fiber bundles in the support fabric is that electrical resistance is reduced.

Materials which are suitable for use as support fabrics include thermoplastic materials such as polyolefins which are polymers of olefins having from about 2 to about 6 carbon atoms in the primary chain as well as their chloro- and fluoro- derivatives.

Examples include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride and copolymers of ethylenechlorotrifluoroethylene.

Preferred olefins include the chloro- and fluoro- derivatives such as polytetrafluoroethylene, fluorinated ethylene-propylene (FEP), polychlorotrifluoroethylene, polyvinyl fluoride, and polyvinylidene fluoride.

Also suitable as support materials are fabrics of polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide. Polyarylene sulfides are well known compounds whose preparation and properties are described in the *Encyclopedia of Polymer Science and Technology* (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

Fabrics which are mixtures of fibers of polyolefins and fibers of polyarylene sulfides can be suitably used as well as layered support fabrics in which the first layer is a polyolefin such as polytetrafluoroethylene and the second layer is a polyarylene sulfide such as polyphenylene sulfide.

The support fabric is impregnated with a siliceous composition having the formula:

$$(X)_m(Si)_p(O)_q(H)_r.nH_2O \qquad \text{I}$$

wherein

X is at least one metal selected from the group consisting of Be, Mg, Ca, Sr, Ba, Ti, Zr, Al, Zn, and mixtures thereof;

p is a number from 1 to about 16;

m is zero to about p;

q is a number from 2 to about 5p+r;

r is zero to about 4 p; and n is zero to about 30.

Siliceous compositions of Formula I include those in which m is a postive number and X is at least one metal from Group IIA of the periodic table. Suitable examples are silicates of beryllium, magnesium, calcium, strontium or barium where the ratio of the metal to silicon is no greater than about 1:1. The compositions include magnesium-containing minerals such as sepiolites, meerschaums, augites, talcs and vermiculites; calcium-containing minerals such as wollastonite, as well as minerals such as tremolite having the formula $CaMg_3.(SiO_3)_4$. Also suitable are synthetic silicates such as commercial magnesium silicates having the approximate composition $2MgO.3SiO_2.2H_2O$, as well as calcium silicate hydrate having the approximate composition $CaO.3.5SiO_2.1.8H_2O$.

Also suitable are synthetic clay materials which are described, for example, in U.S. Pat. Nos. 3,586,478 and 3,671,190 issued to B. S. Neumann; U.S. Pat. Nos. 4,040,974 and 4,054,537 issued to A. C. Wright et al, U.S. Pat. No. 3,666,407 issued to J. K. Orlemann; U.S Pat. No. 3,844,979, issued to D. A. Hickson, or U.S. Pat. No. 3,855,147 issued to W. T. Granquist.

Suitable representatives of siliceous compositions of Formula I where the metal is Ti or Zr include zirconium silicates and benitoite ($BaTiSi_3O_9$).

Where X is aluminum, suitable siliceous compositions of Formula I include aluminum silicates, minerals such as albites, feldspars, labradorites, microclines, nephelines, orthoclases, pyrophyllites, and sodalites; as well as natural and synthetic zeolites.

Snythetic silicate minerals such as those described in U.S. Pat. No. 3,252,757 issued to W. T. Granquist or U.S. Pat. No. 3,252,889 issued to R. G. Capell et al are suitable aluminum-containing compositions.

Also suitable are inorganic compositions in which X is zinc, such as zinc silicates.

Preferred embodiments of siliceous compositions of Formula I are those in which m is a positive number and X is at least one metal selected from the group consisting of Mg, Ca or Al or mixtures thereof, with siliceous compositions of Formula I where X is Mg, Al or mixtures thereof being more preferred. Suitable examples of preferred embodiments include the minerals sepiolites or meerschaums.

Siliceous compositions of Formula I may also include supplementary elements, such as vanadium, niobium, rare earth elements of the lanthanide series, germanium, tin and tungsten. Further, alkali metals such as sodium, potassium and lithium and their oxides are frequently present in siliceous materials suitable as compositions of Formula I. When present in siliceous compositions of Formula I, the above supplementary elements do not represent X and are therefore not included in the determination of m.

In Formula I, where m and r are zero, the siliceous compositions are silica-containing materials which are suitably represented by sand, quartz, silica sand, colloidal silica as well as cristobalite, triolite and chalcedony. The term "sand" includes compositions having a silicon dioxide content of at least about 95 percent by weight.

As indicated by Formula I, the siliceous compositions may be in the form of a hydrate and various amounts of water of hydration can be present.

Siliceous compositions of Formula I may be formed in situ by the interaction of salts of Be, Mg, Ca, Sr, Ba, Ti, Zr, Al and Zn with, for example, silica or an aliali metal silicate. Where X is magnesium, magnesium compounds such as magnesium acetate, magnesium aluminate, magnesium carbonate, magnesium chloride and magnesium peroxide can be employed. For example, a mixture of the appropriate amounts of magnesia (MgO) with silica in the presence of a cell electrolyte such as an alkali metal hydroxide will produce a siliceous composition of Formula I suitable for use in the porous diaphragm of the present invention.

The presence of metals other than those included in Formula I or discussed above as supplementary elements can be tolerated at low concentrations. For example, the concentration of metals such as Fe, Ni, Pb, Ag as well as other heavy metals which may be present in alkali metal chloride brines suitable for electrolysis are preferably below one part per million. Where these metals are present in minerals suitable as siliceous compositions of Formula I, it is preferred that their concentration be less than about 5 percent of the concentration of silicon present in the material.

Similarly, non-metallic materials such as ammonia as well as organic compounds, if present, should be limited to moderate or preferably low levels of concentration.

The degree to which the siliceous composition of Formula I is hydrated serves as a basis for selecting suitable particle sizes. For those compositions which are readily hydrated in the electrolyte solutions used or produced in the cell, a particle size as large as about 100 microns is satisfactory. Where the component is less easily hydrated, the particle size may be substantially reduced. For these compositions, particles having a size in the range of from about 75 microns to about 0.1 micron are more suitable.

Aqueous solutions of ionizable compounds which are suitable as electrolytes include, for example, alkali metal chlorides and alkali metal hydroxides.

In one embodiment of the invention, the electroconductive zone may be produced by applying a coating of an electroconductive metal to a side of the support fabric.

Coatings of electroconductive metals are applied to the support fabric by known methods such as electroplating, catalytic chemical methods ("electroless plating"), as well as painting or spreading the metal or a compound of the metal where applicable.

In order to maintain the desired porosity or permeability of the diaphragm, the metal coating is applied to provide a non-continuous coverage of the fabric. The coatings are substantially surface coatings and penetration of the electroconductive metal into the fabric is minimal. Metal penetration into the fabric support is suitably no greater than about 10 percent and preferably from about 1 to about 5 percent of the thickness of the support fabric.

To aid in the evaluation of the coating, it may be desirable to measure the electrical conductivity of the coating at various stages during application of the metal. This can be done with, for example, two needle-like electrodes plates, for example, with nickel and connected to an Ohm meter. The electrodes, which are spaced apart a distance of one centimeter and have a contact surface of one square millimeter are pressed against the metal coated side of the diaphragm at a pressure of 1 kilogram per centimeter and the resistance measured. Suitably coated diaphragms are those having a resistance of less than about 30 Ohms.

The support fabrics may be coated with the electroconductive metal prior to or after impregnation with the siliceous composition of Formula I. It is, however, frequently more convenient to apply the noncontinuous metal coating to the support fabric prior to its impregnation.

In another embodiment, the electroconductive zone is produced by affixing filaments of an electroconductive metal to at least one side of the support fabric.

The term "filaments" as used in this specification includes fibers, threads or fabrils. The filaments may be those of the electroconductive metals themselves or of materials which can be coated with an electroconductive metal.

Filaments may be affixed to the support fabric individually in arrangements which space apart adjacent filaments to maintain the desired porosity in the porous diaphragm. The filaments may be interconnected to form a web or network. This can be accomplished by affixing individual filaments in the desired arrangement or by providing a substrate such as a fabric which includes the filaments. Any suitable substrate may be used, including, for example, silver coated or carbon coated nylon or polytetrafluoroethylene.

In a preferred embodiment, a web substrate is selected which, after the electroconductive metal has been deposited, has a structure and porosity similar to that of the support fabric which is impregnated with the siliceous composition. This provides for substantially uniform flow of brine through the porous diaphragm without introducing undesired changes in the rate of flow of liquid when passing to or from electroconductive zone of the porous diaphragm.

When a web substrate such as a silver coated fabric is employed, the electroconductive metal may be deposited onto the substrate prior to affixing the substrate to the support fabric.

Filaments may be affixed to the support fabric, for example, by sewing or needling. Thermoplastic materials may be attached using energy sources such as heat or ultrasonic waves. It may also be possible to affix the filaments by the use of an adhesive.

In producing the electroconductive zone, any electroconductive metal may be used which is stable to the cell environment and which does not interact with other cell components.

Suitable electroconductive metals include nickel, nickel alloys, molybdenum, molybdenum alloys, vanadium, vanadium alloys, iron, iron alloys, cobalt, cobalt alloys, magnesium, magnesium alloys, tungsten, tungsten alloys, gold, gold alloys, platinum group metals, and platinum group metal alloys. The term "platinum group metal" as used in the specification means an element of the group consisting of platinum, ruthenium, rhodium, palladium, osmium, and iridium.

Also suitable for providing the electroconductive zone are metallic compounds such as spinels. Spinels are oxycompounds of one or more metals characterized by a unique crystal structure, stoichiometric relationship, and X-ray diffraction pattern. Oxycompounds having the spinel structure may be presented by the formula $$AB_2O_4$$

where A represents a metal having a valence of plus 2 and B represents a metal having a valence of plus 3. The metals A and B may be the same metal as in $Mn_3O_4$ or different metals as in $NiAl_2O_4$. Metals which may be used in spinel structures as the A component include Mg, Mn, Fe, Co, Ni, Cu and Zn. B may represent the metals Al, Cr, Fe, Mn, Co, Ti and V among others.

Preferred electroconductive metals are nickel and nickel alloys, molybdenum and molybdenum alloys, cobalt and cobalt alloys, and platinum group metals and their alloys. It is further preferred that where the side of the diaphragm having the electroconductive zone will contact an ionizable compound such as an alkali metal hydroxide, the electroconductive metal coating be that of nickel or nickel alloys, molybdenum and molybdenum alloys, cobalt and cobalt alloys. Where the side of the diaphragm having the electroconductive zone will contact an ionizable compound such as an alkali metal chloride, the electroconductive metal coating be that of a platinum group metal or an alloy of a platinum group metal.

In addition to employing filaments of the electroconductive metals themselves, other materials may be coated to produce the electroconductive zone.

Materials which may be coated with these electroconductive metals include, for example, metals such as silver or copper, plastics such as polyarylene sulfides, polyolefins produced from olefins having 2 to about 6 carbon atoms and their chloro- and fluoro-derivatives, nylon, melamine, acrylonitrile-butadienestyrene (ABS), and mixtures thereof.

Also suitable for coating are filaments of cellulose, carbon including graphite and glass.

Where the support fabrics or filaments to be coated are non-conductive to electricity, it may be necessary to sensitize the filaments by applying a metal such as silver, aluminum or palladium by known procedures. The electroconductive metals are then deposited on the sensitized portions of the fabric or filament.

The electroconductive zone is insufficient in area to make the impregnated porous diaphragm electroconductive. No electrical leads or contacts are attached to the diaphragm during operation of the cell and the porous diaphragm is incapable of serving as an electrode, for example, in a cell for electrolyzing alkali metal chloride brines to produce chlorine and alkali metal hydroxide.

Porous diaphragms of the present invention may be spaced apart from the electrodes in the cell. In a preferred embodiment, the side of the diaphragm having the electroconductive zone is placed in close proximity to an electrode. For example, when filaments of a metal such as nickel are affixed to one side of the support fabric to form an electroconductive zone, the electroconductive zone is placed in intimate contact with the cathode to reduce hydrogen overvoltage at the cathode and decrease the cell voltage.

While the support fabric may be impregnated with the siliceous composition prior to or after the formation of the electroconductive zone, it is preferred that the impregnation take place after the electroconductive zone has been formed.

Aqueous solutions of ionizable compounds which are suitable as electrolytes include, for example, alkali metal chlorides and alkali metal hydroxides.

The support fabrics may be impregnated with the siliceous composition of Formula I in any of several ways. For example, a slurry of the composition in a solution such as an alkali metal hydroxide or an alkali metal chloride is prepared and the support fabric is impregnated by soaking in the slurry. Another method is to attach the supporting fabric to the cathode and immerse the cathode in the slurry, using the fabric as a filter cloth. Suction means are employed to draw the slurry through the support fabric where the solid particles impregnate the fabric and the filtrate is withdrawn.

In a further embodiment, the support fabric may be impregnated with the siliceous composition by employing means such as rollers to contact the support fabric with the slurry.

It is not necessary to employ a solution or slurry for impregnation purposes. For example, the inorganic siliceous composition of Formula I may be used to form a fluidized bed. A vacuum is employed to suck the particles into the support fabric until the desired degree of impregnation is obtained.

When impregnated, the novel diaphragm of the present invention contains from about 10 to about 100, preferably from about 25 to about 75, and more preferably from about 30 to about 50 milligrams of the siliceous composition per square centimeter of support fabric.

Following impregnation with the siliceous composition of Formula I, the diaphragms have a permeability to alkali metal chloride brines of from about 100 to about 1000, and preferably from about 200 to about 500 milliliters per minute per square meter of diaphragm at a head level difference between the anolyte and the catholyte of from about 0.1 to about 20 inches of brine.

In order to provide similar brine permeability rates, deposited asbestos fiber diaphragms require a greater density which results in higher electrical resistance as indicated by larger voltage coefficients at comparable operating conditions. The novel diaphragms of the present invention are thus more energy efficient than deposited asbestos diaphragms and provide reduced power costs.

The novel diaphragms of the present invention have handling properties which far exceed those of, for example, asbestos. The support diaphragms can be removed from the cell, washed or treated to restore flowability and replaced in the cell without physical damage. During operation of the cell, the novel diaphragms remain dimensionally stable with the support material neither swelling nor being dissolved or deteriorated by the electrolyte, the siliceous composition or the cell products produced.

Electrolytic cells in which the diaphragms of the present invention may be used include those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal or graphite anodes, a cathode assembly having a plurality of foraminous metal cathodes with the novel diaphragm separating the anodes from the cathodes. Suitable electrolytic cells which utilize the novel diaphragms of the present invention include, for example, those types illustrated by U.S. Pat. Nos. 1,862,244; 2,370,087; 2,987,463; 3,247,090; 3,477,938; 3,493,487; 3,617,461 and 3,642,604.

Diaphragms of the present invention may also be suitably used, for example, in cells which electrolyze alkali metal hydroxides to produce hydrogen and oxygen.

When employed in electrolytic cells, the diaphragms of the present invention are sufficiently flexible so that they may be mounted on or supported by an electrode such as a cathode.

During electrolysis of alkali metal chloride solutions, the siliceous compositions of Formula I produce a gel-like formation which is permeable to alkali metal ions. While the gel-like formations may be produced throughout the diaphragm they are normally produced within the support fabric in the portion which is adjacent to the anolyte side. The extent of gel formation within the support fabric varies, for example, with the thickness of the support fabric and the concentration of alkali metal hydroxide in the catholyte liquor. Preferred diaphragms are those which have a gel-free portion in contact with the catholyte. Gel formation is believed to occur during hydration of the siliceous composition. The gel is believed to be soluble in the catholyte liquor and it is desirable that the rate of dissolution be controlled to maintain a suitable equilibrium between gel formation and dissolution for efficient operation of the cell. The presence of metals and compounds represented by X in Formula I in the gel is believed to be one way of increasing the stability of the gel and thus reduce its rate of dissolution. Another way appears to be the selection of suitable particle sizes for the inorganic composition. Gel-free portions of the diaphragm are attained, for example, by controlling the areas of the support fabric which are impregnated with the siliceous composition or by controlling the concentration of the electrolytes in the anode and cathode compartments. Efficient cell operation is attained by controlling the equilibrium sufficiently to produce a caustic liquor containing silica in amounts of from about 10 to about 150 parts per million. This may be obtained by periodically adding the inorganic siliceous composition of Formula I to the brine in suitable amounts. Alkali metal chloride brines used in the electrolytic process normally contain concentrations of silica of from about 10 to about 30 parts per million and thus the brine may supply sufficient silica to maintain the equilibrium and supplemental addition of inorganic composition may not be necessary.

The porous diaphragms of the present invention are illustrated by the following examples without any intention of being limited thereby.

EXAMPLE 1

A section of polytetrafluoroethylene felt having a thickness of 0.068 of an inch was sprayed on one side with a silver metallizing paint. The silver paint was applied in a manner which provided a noncontinuous coating on the felt and which minimized penetration of the paint into the felt. Electrical conductivity of the painted fabric was determined by contacting the painted surface with two nickel plated, needle-like electrodes, each having a contact surface of one square millimeter. The electrodes, each connected to an Ohm meter, were pressed against the painted side at a pressure of one kilogram per square meter. A distance of one centimeter separated the two electrodes. Silver spraying was discontinued when the resistance was below about 0.1 Ohm. After drying, the painted felt was immersed in an electroplating bath containing an aqueous nickel plating solution containing:

nickel sulfate: 300 grams per liter
nickel chloride: 60 grams per liter
boric acid: 6 grams per liter
sodium molybdate: 0.3 grams per liter
vanadyl sulfate: 0.4 grams per liter A current of 0.02 $KA/m^2$ was passed through the solution for a period of about 4 hours, then the current increased to 0.1 $KA/m^2$ for an additional 2 hours. Electroplating was completed employing a current of 0.4 to 0.6 $KA/m^2$ for about 2 hours. After removal from the plating bath, the felt, coated on one side with a nickel-molybdenum-vanadium alloy, was rinsed in tap water and then washed with a 20 percent solution of caustic soda. The felt was fitted on a louvered steel mesh cathode with the coated side in contact with the cathode surface.

The felt covered cathode was immersed in a sodium chloride brine (295–305 gpl of NaCl) having dispersed therein about 5 percent by volume of sepiolite. Analysis of the sepiolite ($H_4Mg_2Si_3O_{10}.nH_2O$) indicated oxides of the following elements were present as percent by weight: Si 79.1; Mg 9.3; K 4.8; Ca 4.8; Al 1.4; and Fe 1.4.

A vacuum was applied to impregnate the felt with the dispersion until a vacuum of 23 to 27 inches was reached. The vacuum was shut off and the procedure repeated three times.

The impregnated, felt-covered cathode was installed in an electrolytic cell employing a ruthenium oxide coated titanium mesh anode and sodium chloride brine at a pH of 12, a concentration of 315–320 grams of NaCl per liter and a temperature of 90° C. Current was passed through the brine at a density of 2.0 kiloamps per square meter of anode surface. The initial brine head level was 0.5 to 1 inch greater in the anode compartment than in the cathode compartment. The permeability of the impregnated diaphragm was found to be in the range of from about 200 to about 250 milliliters per square meter of diaphragm by measuring the rate of catholyte liquor produced. The cell was operated for six weeks to produce a catholyte liquor having a concentration of 131–188 grams per liter of NaOH at a cathode current efficiency range of 87 to 94 percent. Cell voltage was in the range of 3.1 to 3.2 volts. The catholyte liquor produced had a sodium cloride concentration in the range of 130–170 grams per liter.

COMPARATIVE EXAMPLE A

A polytetrafluoroethylene felt having a thickness of 0.068 of an inch thick was impregnated with sepiolite using the procedure of Example 1. The felt, however, had not been previously coated on one side with the Ni alloy. The impregnated felt was then fitted to a louvered steel mesh cathode and electrolysis of sodium chloride conducted in the same cell and employing identical conditions and brine concentration. A catholyte liquor having a concentration equivalent to that of Example 1 was obtained at current efficiencies of 87–94 percent, however, the cell voltage was in the range of 3.2 to 3.4 volts.

Employing the diaphragm of Example 1 having a non-continuous metal coating results in a substantial decrease in cell voltage over the use of an uncoated diaphragm.

EXAMPLE 2

A section of polypropylene felt fabric having an air permeability of about 5 cubic feet per minute was coated with a thin noncontinuous coating of nickel using the plating procedure of Example 1. The nickel-coated polypropylene felt was then impregnated with sepiolite using the sodium chloride brine slurry and vacuum procedure to Example 1. After impregnation, the diaphragm was fitted on a louvered steel cathode so that the nickel coated side was adjacent to the anode. When employed in the cell of and using the electrolysis method of Example 1, the diaphragm was operated satisfactorily for a period of one month at a cell voltage in the range of 3.4 to 3.7 volts to produce a catholyte liquor having a concentration of 135±20 gpl of NaOH at a cathode current efficiency of 90±2 percent.

COMPARATIVE EXAMPLE B

A section of polypropylene felt identical to that used in Example 2 was impregnated with sepiolite in the same manner as that of Example 2. The felt, however, was not coated with an electroconductive metal. When employed in the cell of Example 1 and using the electrolysis method of that Example, the polypropylene felt diaphragm was destroyed in less than one week of cell operation.

Example 2 thus shows that an electroconductive metal coating on the side of the diaphragm facing the anode substantially increases the service life of the diaphragms.

EXAMPLE 3

A silver coated nylon web was sewn to one side of a section of polytetrafluoroethylene felt 0.095 of an inch thick. The web had a thickness of approximately one-tenth of that of the felt and a surface area of 4 square meters per gram of fibers. The silver sensitized felt was immersed in an electroplating bath containing 450 grams per liter of nickel sulfamate and 30 grams per liter of boric acid at a pH in the range of 3–5. Electric current at a density of 0.5 $KA/m^2$ was passed through the solution for a period of about 2 hours. During the electroplating, an electroconductive coating was deposited on the silver coated fibers to produce a porous diaphragm having a nickel coating on portions of one surface. After removal from the plating bath, the felt was rinsed in tap water and then washed with a 20 percent solution of caustic soda. The felt section (150 square centimeters) was fitted on a steel mesh cathode with the coated surface in contact with the cathode surface. The felt was then impregnated with sepiolite using the procedure of Example 1 to provide a porous diaphragm having 50 milligrams per centimeter of sepiolite.

The impregnated, felt-covered cathode was installed in an electrolytic cell employing a ruthenium oxide coated titanium mesh anode and sodium chloride brine at a pH of 2±0.5, a concentration of 305±5 grams of NaCl per liter and a temperature of 85°±5° C. A polytetrafluoroethylene spacer was placed between the anode and the porous felt diaphragm to provide a gap of 0.25 of an inch. The spacer also pressed the felt against the cathode to assure good contact between the nickel coated surface of the porous diaphragm and the cathode surface. Current was passed through the brine at a density of 2.0 kiloamps per square meter of anode surface. The initial brine head level was 0.5 to 1 inch greater in the anode compartment than in the cathode compartment. The permeability of the impregnated diaphragm was found to be in the range of from about 250 to about 350 milliliters per square meter of diaphragm by measuring the rate of catholyte liquor produced. The cell was operated for 15 days to produce a catholyte liquor having a concentration of 135±12 grams per liter of NaOH at a cathode current efficiency range of 90 to 94 percent. Cell voltage was 2.85±0.05 volts. The catholyte liquor produced had a sodium chloride concentration in the range of 180±15 grams per liter. Power consumption was calculated to be in the range of 2060 to 2210 KWH per ton of chlorine produced.

EXAMPLE 4

A section of polytetrafluoroethylene felt having a web of silver coated nylon fibers sewn to one surface was coated on this sensitized surface with nickel using the procedure of Example 3. The porous diaphragm was fitted onto a steel cathode with the metal coated surface in contact with the steel cathode. The felt was impregnated with sepiolite using the identical procedure of Example 1. The impregnated porous diaphragm was installed in the electrolytic cell employed in Example 3. A polytetrafluoroethylene spacer was placed between the anode and the porous felt diaphragm to assure intimate contact between the nickel coated side of the diaphragm and the cathode. The anode to cathode gap was 0.25 of an inch. Sodium chloride brine (305±5 grams per liter of NaCl) at a pH of 2±0.5 and a temperature of 85°±5° C. was fed to the anode compartment. The electrolytic cell was operated at four different current densities and the cell voltages obtained are shown below in Table I.

COMPARATIVE EXAMPLE C

Example 4 was repeated exactly using a section of polytetrafluoroethylene felt of the type used in Example 4 without the web of silver coated nylon attached. The felt section was not plated with the nickel alloy applied in Example 4. After installing the porous diaphragm onto the cathode, the electrolysis of sodium chloride was conducted at the same current densities as those employed in Example 4. The results are tabulated in Table 1 below.

TABLE 1

| Current Density | Cell Voltage (volts) | |
|---|---|---|
| (Kiloamps/meter) | Example 4 | Comparative Example C |
| 1.0 | 2.3 | 2.65 |
| 2.0 | 2.76 | 3.05 |
| 3.0 | 3.15 | 3.55 |
| 4.0 | 3.55 | 4.10 |

As shown in the above Table, there was a substantial reduction in the cell voltage during electrolysis when the nickel alloy-coated diaphragm was installed in contact with the cathode as compared with the uncoated diaphragm. At each current density employed, the cell voltage was reduced by at least 0.29 volts when the diaphragm having an electroconductive zone was employed.

What is claimed is:

1. In an electrolytic diaphragm cell for the electrolysis of aqueous solutions of ionizable compounds, said cell having an anode assembly containing a plurality of anodes, a cathode assembly having a plurality of cathodes, a diaphragm separating said anode assembly from said cathode assembly, and a cell body housing said anode assembly and said cathode assembly, the improvement which comprises a porous diaphragm comprised of a thermoplastic support fabric impregnated with particles of a siliceous composition having the formula:

$$(X)_m(Si)_p(O)_q(H)_r \cdot nH_2O$$

wherein

X is at least one metal selected from the group consisting of Be, Mg, Ca, Sr, Ba, Ti, Zr, Al, Zn and mixtures thereof;

p is a number from 1 to about 16;

m is zero to about p;

q is a number from 2 to about 5p+r;

r is zero to about 4p; and n is zero to about 30;

said siliceous compositions being capable of undergoing hydration when in contact with at least one of said ionizable compounds in said electrolytic cell; said support fabric having an electroconductive zone along one side of said fabric support; and said support fabric having means to provide linear permeability to said aqueous solutions.

2. A porous diaphragm for an electrolytic cell for the electrolysis of aqueous solutions of ionizable compounds which comprises a thermoplastic support fabric impregnated with particles of a siliceous composition having the formula:

$$(X)_m(Si)_p(O)_q(H)_r.nH_2O$$

wherein

X is at least one metal selected from the group consisting of Be, Mg, Ca, Sr, Ba, Ti, Zr, Al, Zn, and mixtures thereof;

p is a number from 1 to about 16;

m is zero to about p;

q is a number from 2 to about 5p+r;

r is zero to about 4p; and n is zero to about 30;

said siliceous compositions being capable of undergoing hydration when in contact with at least one of the ionizable compounds in the electrolytic cell; said support fabric having an electroconductive zone along one side of said support fabric and said support fabric having means to provide linear permeability to said aqueous solutions.

3. The porous diaphragm of claim 2 in which X is at least one metal selected from the group consisting of Be, Mg, Ca, Sr, Ba, aluminum and mixtures thereof, and m is a positive number.

4. The porous diaphragm of claim 3 in which said support fabric is a polyolefin selected from the group consisting of polypropylene, polytetrafluoroethylene, fluorinated ethylene-propylene, polychlorotrifluoroethylene, polyvinyl fluoride and polyvinylidene fluoride.

5. The porous diaphragm of claim 4 in which said electroconductive zone comprises said support fabric having on one side a non-continuous coating of an electroconductive metal.

6. The porous diaphragm of claim 5 in which said electroconductive metal is selected from the group consisting of nickel, nickel alloys, molybdenum, molybdenum alloys, cobalt, cobalt alloys, vanadium, vanadium alloys, tungsten, tungsten alloys, gold, gold alloys, platinum group metals and platinum group metal alloys.

7. The porous diaphragm of claim 6 in which said electroconductive metal is nickel or nickel alloys.

8. The porous diaphragm of claim 5 in which said electroconductive zone is no greater than about 10 percent of the thickness of said support fabric.

9. The porous diaphragm of claim 4 in which X is Al and said siliceous compositions are selected from the group consisting of aluminum silicates, albites, feldspars, labradorites, microclines, nephelines, orthoclases, pyrophyllites, sodalites, natural zeolites, and synthetic zeolites.

10. The porous diaphragm of claim 3 in which said electroconductive zone comprises filaments of an electroconductive metal affixed to said support fabric.

11. The porous diaphragm of claim 10 in which said filaments are in the form of a web.

12. The porous diaphragm of claim 11 in which said filaments are selected from the group consisting of nylon, melamine, acrylonitrile-butadiene-styrene (ABS), cellulose, glass, carbon and mixtures thereof, said filaments having a coating thereon of said electroconductive metal.

13. The porous diaphragm of claim 12 in which said support fabric is a felt fabric comprised of polytetrafluoroethylene.

14. The porous diaphragm of claim 13 in which said filaments are nylon.

15. The porous diaphragm of claim 13 in which said siliceous composition is selected from the group consisting of magnesium silicates, sepiolites and meerschaums.

16. The porous diaphragm of claim 10 in which said electroconductive metal is selected from the group consisting of nickel, nickel alloys, molybdenum, molybdenum alloys, cobalt, cobalt alloys, vanadium, vanadium alloys, tungsten, tungsten alloys, gold, gold alloys, platinum group metals and platinum group metal alloys.

17. The porous diaphragm of claim 16 in which said electroconductive metal is nickel or nickel alloys.

18. The porous diaphragm of claim 10 in which said electroconductive zone is no greater than about 10 percent of the thickness of said support fabric.

19. The porous diaphragm of claim 3 in which said support fabric is a polyarylene sulfide selected from the group consisting of polyphenylene sulfide, polynaphthalene sulfide, poly(perfluorophenylene) sulfide, and poly(methylphenylene) sulfide.

20. The porous diaphragm of claim 19 in which said support fabric is polyphenylene sulfide.

21. The porous diaphragm of claim 19 in which said siliceous composition is selected from the group consisting of magnesium silicates, sepiolites and meerschaums.

22. An electrolytic cell employing the porous diaphragm of claim 1 in which said ionizable compounds are alkali metal chlorides or alkali metal hydroxides.

23. The cell of claim 22 in which said electroconductive zone of said porous diaphragm is placed in intimate contact with the cathode.

* * * * *